US006006392A

United States Patent [19]

Seculov et al.

[11] Patent Number: 6,006,392

[45] Date of Patent: Dec. 28, 1999

[54] SELF-WRINGING MOP

[75] Inventors: Emil B. Seculov, Columbus; Paul R. Burger, Lebanon, both of Ohio

[73] Assignee: O-Cedar Brands, Inc., Springfield, Ohio

[21] Appl. No.: 09/039,098

[22] Filed: Mar. 13, 1998

[51] Int. Cl.[6] ..... A47L 13/142

[52] U.S. Cl. ..... 15/120.2; 15/229.1

[58] Field of Search ..... 15/116.1, 119.1, 15/120.1, 120.2, 229.2, 229.1

[56] References Cited

U.S. PATENT DOCUMENTS

| | | | |
|---|---|---|---|
| 1,520,500 | 12/1924 | Jumonville . | |
| 1,760,695 | 5/1930 | Hertzberg . | |
| 2,230,101 | 1/1941 | Bakemeier . | |
| 2,495,846 | 1/1950 | Johnson | 15/120.2 |
| 2,668,970 | 2/1954 | Cooper . | |
| 4,479,278 | 10/1984 | Heinonen . | |
| 5,509,163 | 4/1996 | Morad . | |
| 5,566,417 | 10/1996 | Hsieh . | |
| 5,577,290 | 11/1996 | Monahan . | |

FOREIGN PATENT DOCUMENTS

| | | |
|---|---|---|
| 0311745 | 2/1956 | Switzerland . |

*Primary Examiner*—Terrence R. Till
*Attorney, Agent, or Firm*—Biebel & French

[57] ABSTRACT

A self-wringing mop including an elongated handle, a sleeve slidably mounted on the handle and a flexible relatively long mopping member having a first end attached to the sleeve and a second end attached to a lower end of the handle. The mopping member includes material defining a plurality of flaps which are movable to a location below the lower end of the handle in response to movement of the sleeve toward the lower end of the handle. The plurality of flaps are connected to each other by a circumferentially extending extent of material of the mopping member to form a bonnet adjacent to a lower end of the flaps.

13 Claims, 5 Drawing Sheets

SELF-WRINGING MOP

BACKGROUND OF THE INVENTION

The present invention relates to a self-wringing mop and, more particularly, to a self-wringing mop having a mopping member with a specially configured end portion to facilitate alignment of mop strands for the mopping member during a wringing operation.

Conventional self-wringing mops are typically provided with mop strands having lower ends connected to a bottom or base of a shaft or handle, and opposing ends connected to a tubular member that may be rotatably slid along the handle to move the mop strands between a wringing position and a use position. The mop strands may be wrung dry by extending the length of the mop strands and twisting the tubular member, and the upper ends of the mop strands, about the handle.

One problem associated with prior art self-wringing mops arises from misalignment of the strands as they are moved from a use or mopping position to the wringing position. During a mopping operation, the mop strands often become bunched or tangled as a result of movement of the bottom of the mop handle, and associated mop connection location, relative to the loops of strands engaged with a floor surface. When the sleeve holding the upper end of the mop strands is subsequently drawn upwardly to wring the strands, the bunched or tangled strands will interfere with the bottom of the mop handle resulting in a nonuniform distribution of the strands along the handle during the wringing operation. Such a nonuniform distribution of strands may result in incomplete wringing of the strands and a resultant reduction in the efficiency of the mop.

Prior art solutions to address the problem of bunching and tangling mop strands include providing ties wrapped around adjacent mop strands at predetermined intervals to maintain proper alignment between the strands. However, providing ties between the strands requires additional assembly steps, and further does not necessarily ensure that the bottom portion of the mop handle will not pass through and become entangled in untied areas of the strands.

SUMMARY OF THE INVENTION

The present invention provides a self-wringing mop including an elongated handle and a sleeve slidably and rotatably mounted on the handle. A flexible, relatively long mopping member is provided having a first end attached to the sleeve and a second end attached to a lower end of the handle at a stationary attachment point. The mopping member includes material defining a plurality of flaps which are movable to a location below the lower end of the handle in response to movement of the sleeve toward the lower end of the handle. The plurality of flaps are connected to each other by a circumferentially extending extent of the material of the mopping member to form a bonnet adjacent the lower end of the handle.

The material of the mopping member comprises a continuous sheet of material configured as a tubular mop swab surrounding the handle. The plurality of flaps are defined by a plurality of slits formed in the sheet of material and extending longitudinally substantially parallel to the handle. The lower portion of the tubular mop swab defines the bonnet and the bonnet is freely movable relative to the handle between the stationary attachment point and the lower end of the flaps where they are connected to the bonnet.

The bonnet provides a stabilizing member for the flaps to control the position of the flaps during a mopping operation.

The length of the bonnet is such that the flaps are prevented from becoming bunched and entangled with each other and with the bottom of the mop handle.

Therefore, it is an object of the present invention to provide a self-wringing mop which prevents bunching and entanglement of a mopping member for the mop.

It is a further object of the invention to provide a self-wringing mop including a mopping member formed of a continuous sheet of material and including flaps defined by slits in the sheet of material wherein the flaps are prevented from becoming bunched or entangled.

It is yet another object of the invention to provide such a self-wringing mop wherein an unslit portion of the mopping member forms a tubular bonnet for controlling the position of the flaps during mopping and wringing operations.

Other objects and advantages of the invention will be apparent from the following description, the accompanying drawings and the appended claims.

DETAILED DESCRIPTION IF THE PREFERRED EMBODIMENT

Figure 1:
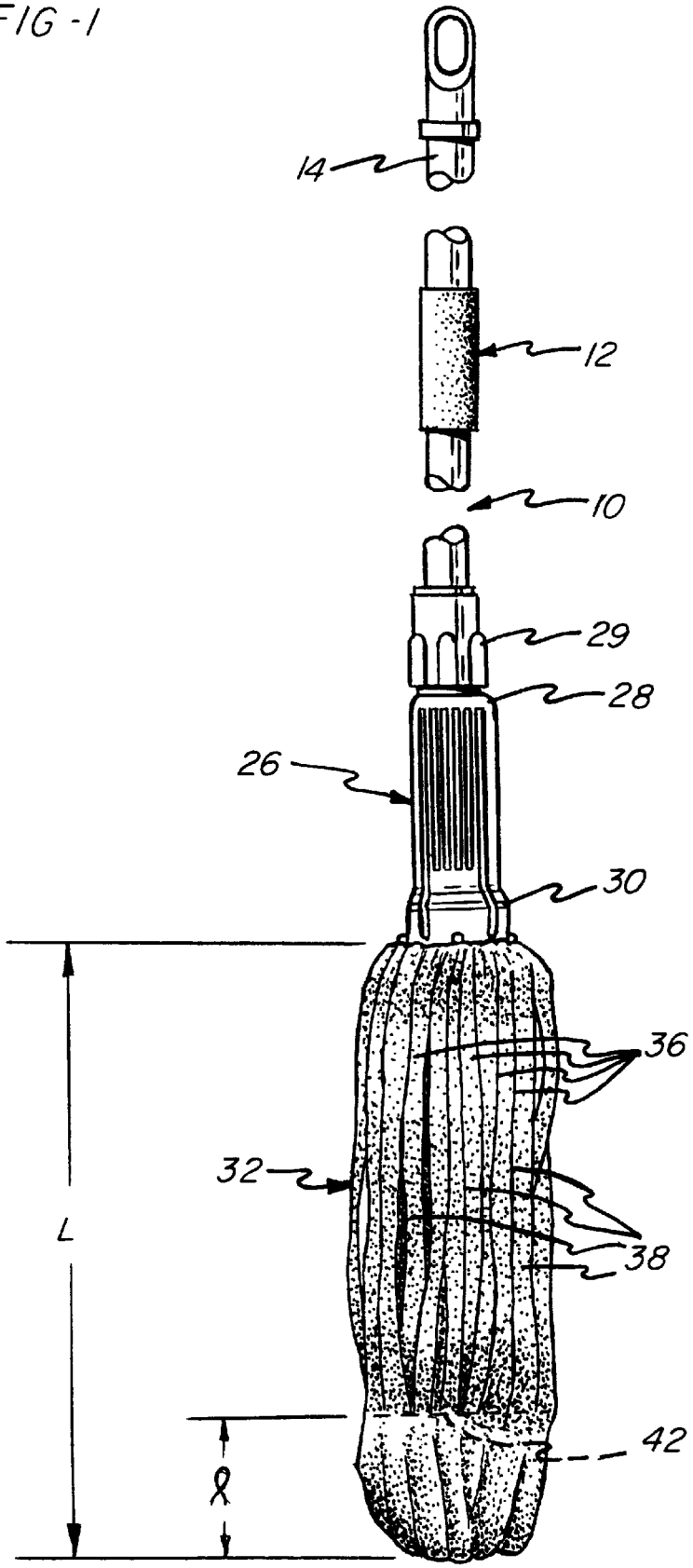
FIG. 1 is a side elevational view of the self-wringing mop of the present invention with the mop strands in an extended position.
Figure 2:
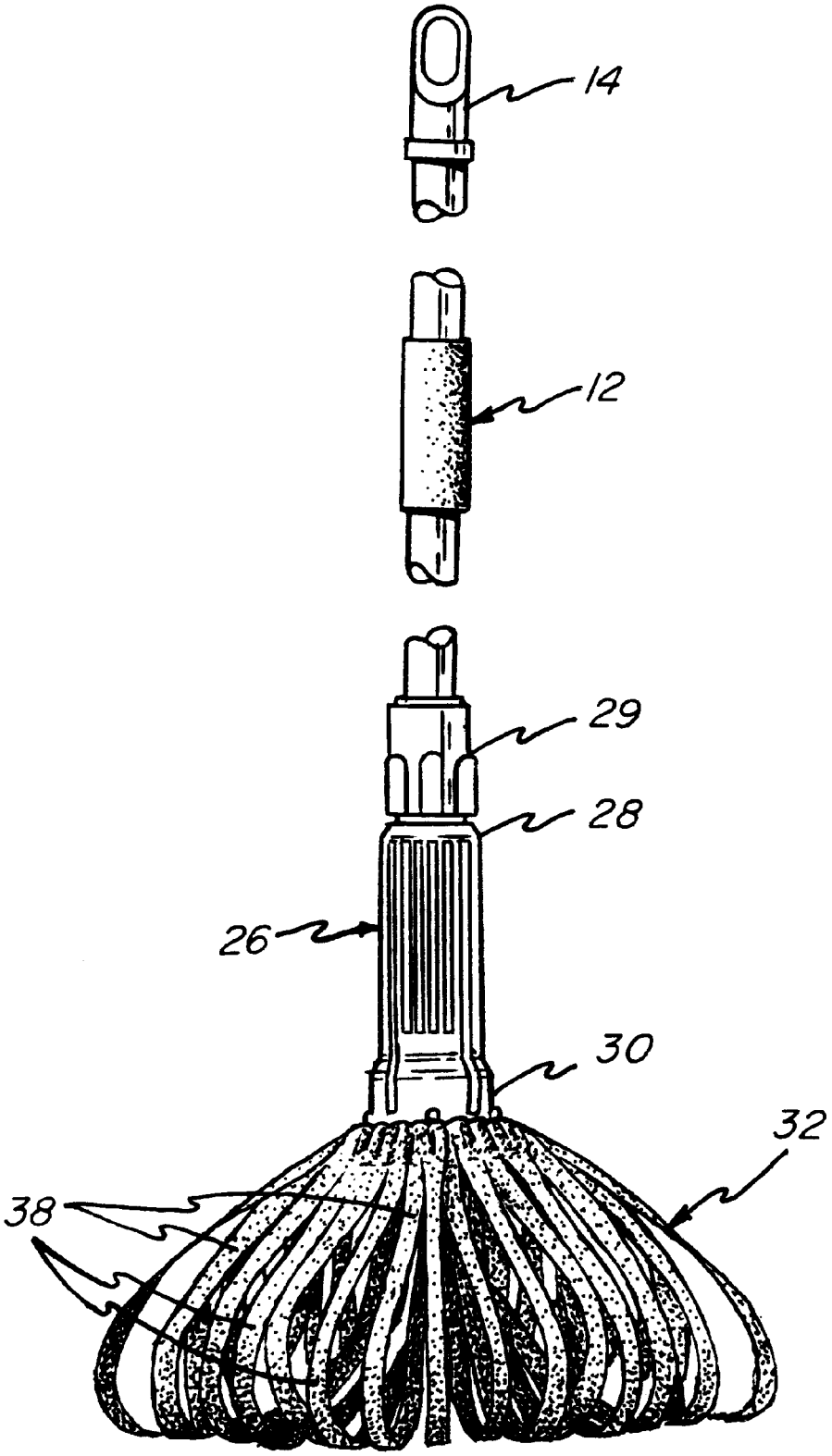
FIG. 2 is a side elevational view of the self-wringing mop showing the mop strands positioned for a mopping operation.

Referring to FIGS. 1–5, the self-wringing mop 10 of the present invention includes an elongated handle 12 having an upper end 14 and a lower end 16. The handle is preferably formed as a hollow member and the lower end 16 receives an elongated upper portion 18 of a bell shaped connector 20. The connector 20 is held in place by a pin 22 inserted through an aperture in the handle 12 and extending through the upper portion 18 of the connector 20. In addition, the connector 20 includes a clip 24 inserted in a lower portion of the connector 20 for purposes described further below. The connector 20 is substantially similar to the connector described in U.S. Pat. No. 5,615,442, assigned to the assignee of the present invention, and incorporated herein by reference.

A tubular sleeve 26 is slidably and rotatably supported for movement along the handle 12 intermediate the upper and lower ends 14, 16 and includes an upper sleeve end 28 and a lower sleeve end 30. The upper sleeve end 28 supports a locking collar 29 and the lower sleeve end 30 supports a first end of a flexible, relatively long mopping member 32, and a second end of the mopping member 32 is attached to the connector 20 by the clip 24.

Figure 3:
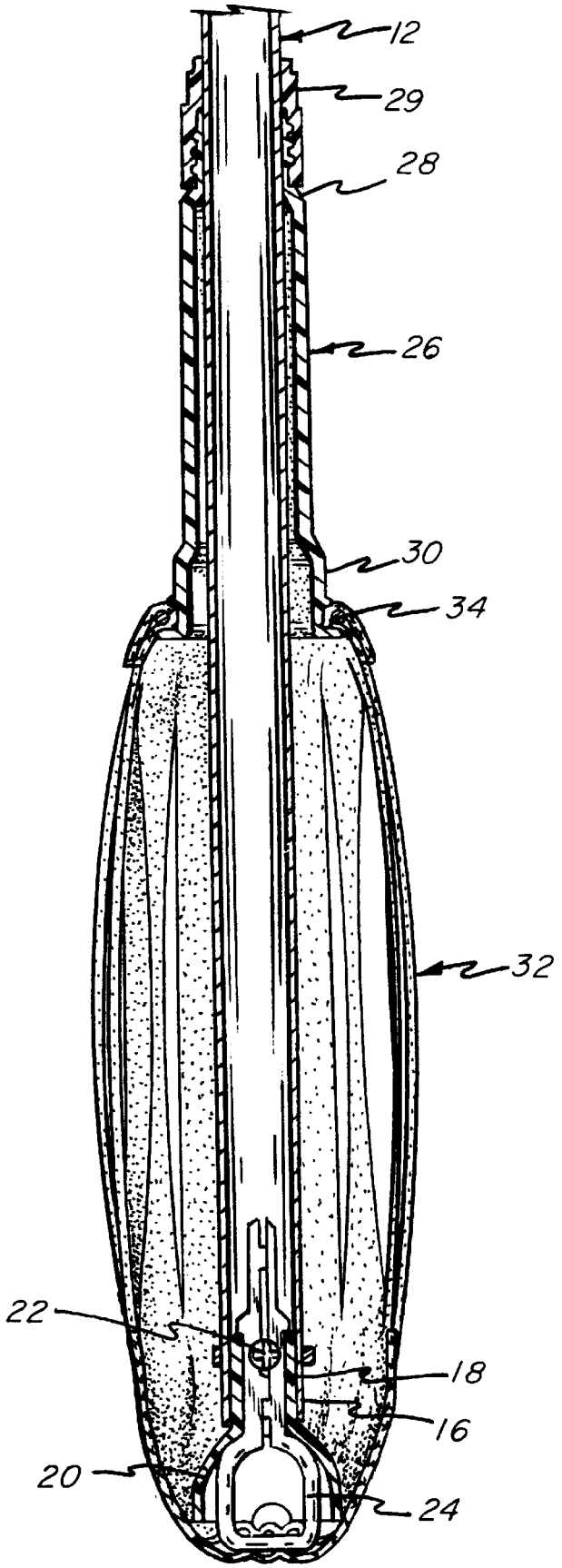
FIG. 3 is a cross-sectional view of the self-wringing mop in the position shown in FIG. 1.
Figure 4:
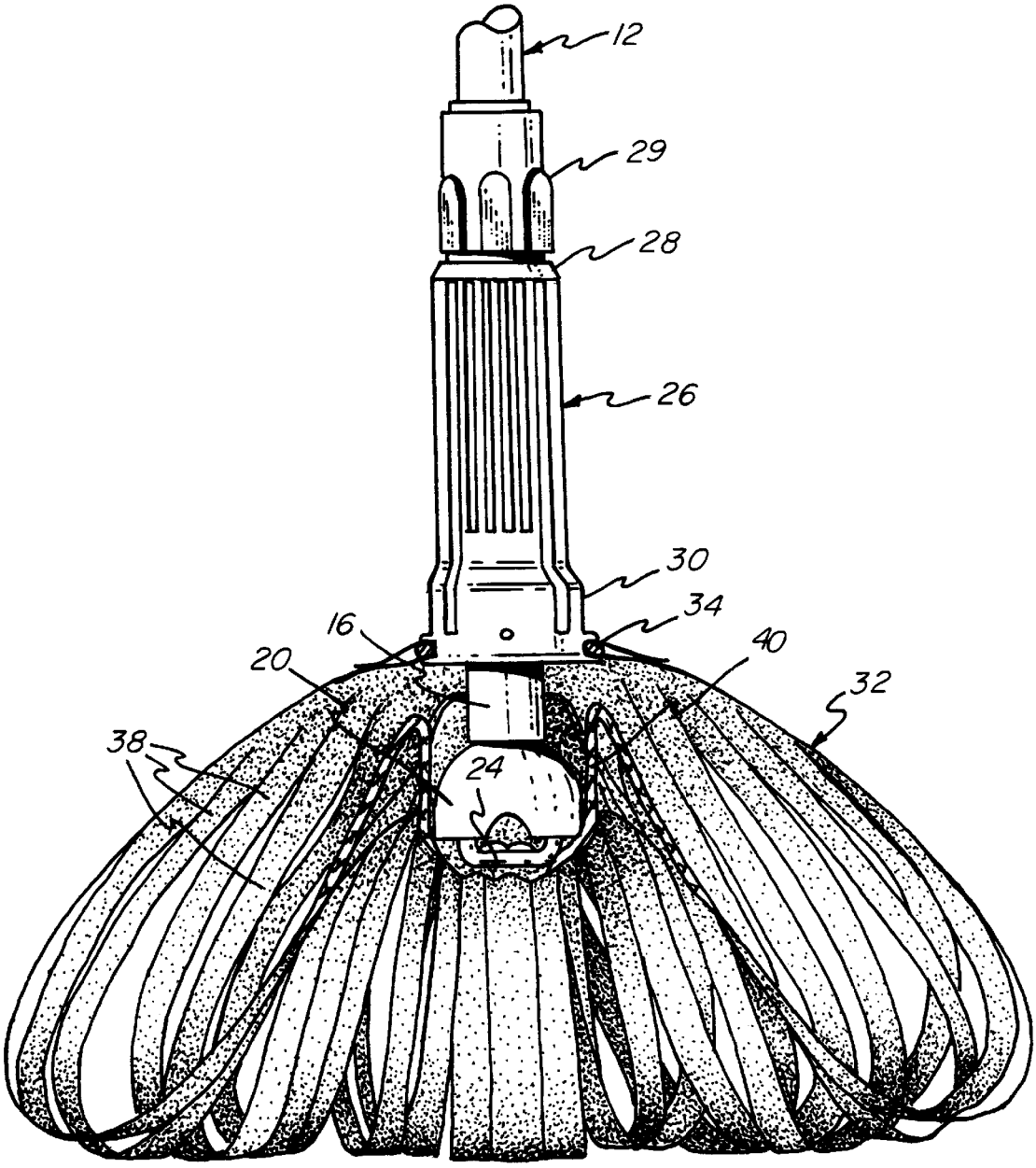
FIG. 4 is a partial cross-sectional view of the self-wringing mop in the position shown in FIG. 2.
Figure 5:
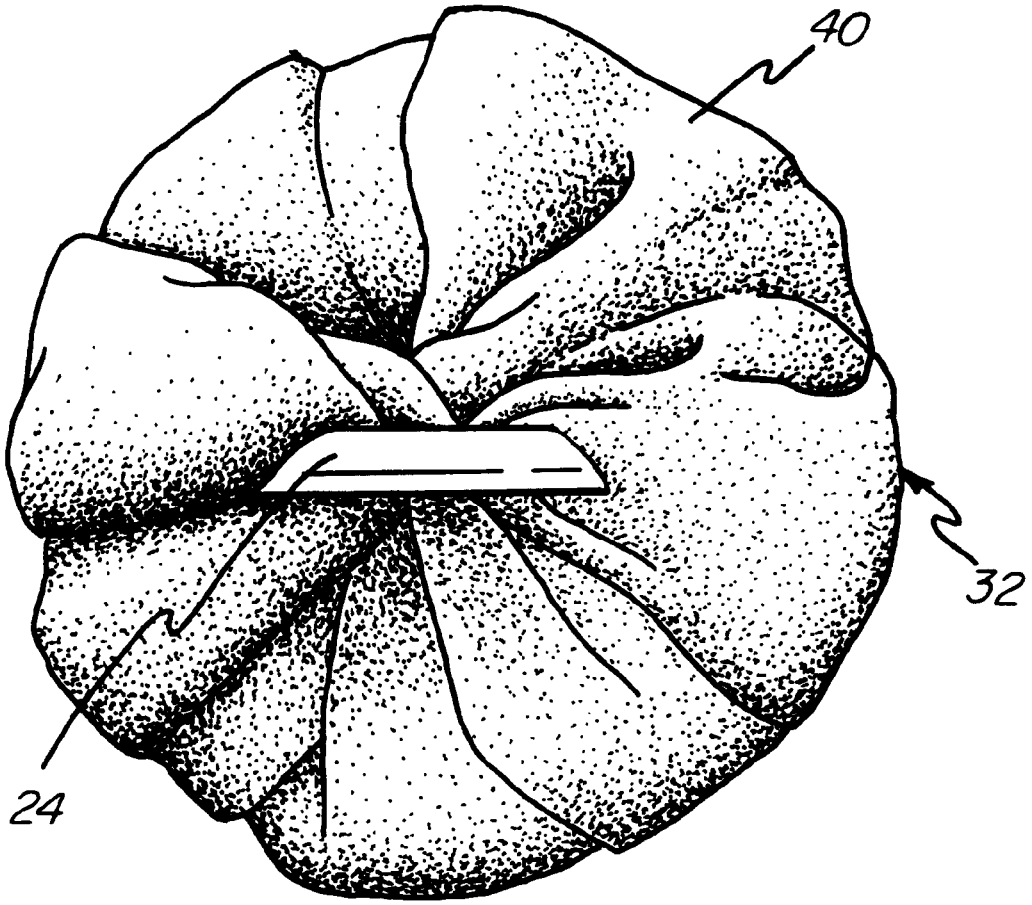
FIG. 5 is a bottom view of the self-wringing mop in the position shown in FIG. 1.

As best seen in FIGS. 1 and 3, the mopping member 32 comprises a continuous sheet of material wrapped about a longitudinal axis of the handle 12 to form a tubular mop swab. The first end of the mopping member 32 is overlapped around a ring member 34 extending circumferentially about the lower end 30 of the sleeve 26 to thereby hold the mopping member 32 in place at the first attachment point.

The second end of the mopping member 32 is held in engagement with the connector 20 by means of the clip 24 extending through apertures in the lower end of the mopping member 32 (FIG. 5) and extending upwardly through the upper portion 18 of the connector 20.

The mopping member 32 is formed of a non-woven fabric of a cellulose and synthetic resin fiber blend and is provided with a plurality of slits 36 to define a plurality of strands or flaps 38 in the material. The flaps 38 define elongated planar strand members and are positioned in overlapping relationship to each other at the first attachment point on the sleeve 26, and the flaps 38 include a lower terminal end spaced from the second attachment point defined by the connector 20.

A circumferentially extending extent of the material of the mopping member 32 forms a tubular bonnet 40 extending between the lower terminal end of the flaps 38 and the second attachment point at the connector 20 wherein an upper end 42 of the bonnet 40 defines a connection between adjacent flaps 38. The bonnet 40 provides a relatively stiff support for the lower ends of the flaps 38 and is freely movable relative to the handle 12 between the connector 20 and the lower end of the flaps 38. However, the tubular bonnet 40 generally maintains the lower end of the flaps 38 at a location located above the lower end of the handle 12 and connector 20. Further, as the sleeve 26 is moved downwardly on the handle 12 to position the flaps 38 below the end of the handle 12 for mopping, the bonnet 40 tends to direct the flaps 38 radially outwardly to prevent bunching and tangling of the flaps as they are moved relative to the handle during a mopping operation, and as they are subsequently drawn upwardly by the sleeve 26 for a wringing operation. In order for the bonnet 40 to position the lower end of the flaps 38 to avoid bunching and entanglement, the length 1 of the bonnet 40 is preferably approximately 20% of the overall length L of the mopping member 32.

It should be noted that the present construction for the mopping member 32, including the bonnet 40, simplifies the manufacture and assembly of the mop 10 of the present invention over that of prior art mops. In particular, the bonnet 40 provides a convenient means for maintaining the lower end of the flaps 38 at a desired location relative to the lower end of the handle without requiring additional structures or assembly steps during preparation of the mop 10 in that the bonnet 40 is formed of the same continuous sheet of material as that of the flaps 38, and the flaps 38 are easily formed by formation of the slits 36 in the material of the mopping member 32.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A self-wringing mop comprising:

an elongated handle having an upper end and a lower end;

a sleeve slidably mounted on said handle intermediate said upper and lower ends;

a flexible, relatively long mopping member having a first end attached to said sleeve and a second end attached to said lower end of said handle at a stationary attachment point, said mopping member including material defining a plurality of flaps which are movable to a location below said lower end of said handle in response to movement of said sleeve toward said lower end of said handle; and wherein said plurality of flaps are connected to each other by a continuous circumferentially extending extent of said material of said mopping member to form a bonnet adjacent a lower end of said flaps and between said upper and lower ends of said handle, and said circumferentially extending extent of material includes said second end attached to said lower end of said handle.

2. The mop of claim 1 wherein said mopping member comprises a continuous sheet of material configured as a tubular mop swab surrounding said handle.

3. The mop of claim 2 wherein said plurality of flaps are defined by a plurality of slits formed in said sheet of material extending longitudinally substantially parallel to said handle.

4. The mop of claim 2 wherein a lower portion of said tubular mop swab defines said bonnet and said bonnet is freely movable relative to said handle between said stationary attachment point and said lower end of said flaps.

5. The mop of claim 1 wherein each of said flaps is positioned in overlapping relation to an adjacent flap at said first end attached to said sleeve.

6. The mop of claim 1 wherein said bonnet has a length along said handle which is approximately 20 percent of the overall length of said mopping member along said handle.

7. A self-wringing mop comprising:

an elongated handle having an upper end and a lower end;

a sleeve slidably mounted on said handle intermediate said upper and lower ends of said handle and including upper and lower sleeve ends;

a flexible, relatively long mopping member comprising a continuous sheet of material wrapped around a longitudinal axis of said handle to form a tubular mop swab, said continuous sheet of material having a first end attached at a first attachment point to said lower sleeve end and a second end attached at a second attachment point to said lower end of said handle;

a plurality of flaps defined by slits formed in said continuous sheet of material and extending longitudinally from said first attachment point to a lower location spaced from said second attachment point; and wherein said material between said lower location and said second attachment point defines a circumferentially extending tubular bonnet, and an upper end of said bonnet connects adjacent flaps to each other.

8. The mop of claim 7 wherein said handle comprises a hollow lower end and includes a connector inserted into said hollow lower end, said connector defining said second attachment point.

9. The mop of claim 7 wherein said mopping member is freely movable relative to said handle between said first attachment point and said second attachment point.

10. The mop of claim 9 including a connector inserted into said lower end of said handle, said connector attaching said continuous sheet of material to said handle to define said second attachment point.

11. The mop of claim 7 wherein each of said flaps is positioned in overlapping relation to an adjacent flap at said first attachment point.

12. The mop of claim 7 wherein said bonnet has a length along said handle which is approximately 20 percent of the overall length of said mopping member along said handle.

13. A self-wringing mop comprising:

an elongated handle having an upper end and a lower end;

a connector inserted into said lower end of said handle;

a sleeve slidably mounted on said handle intermediate said upper and lower ends of said handle and including upper and lower sleeve ends;

a flexible, relatively long mopping member comprising a continuous sheet of material wrapped about a longitudinal axis of said handle to form a tubular mop swab, said continuous sheet of material having a first end attached at a first attachment point to said lower sleeve end and a second end attached at a second attachment point to said connector;

a plurality of elongated planar flaps defined by slits formed in said continuous sheet of material and extending longitudinally from said first attachment point to a lower location spaced from said second attachment point;

a circumferentially extending tubular bonnet defined by said continuous sheet of material between said lower location and said second attachment point, an upper end of said bonnet defining a connection between adjacent flaps; and wherein said bonnet is freely movable relative to said handle and extends along said handle a length which is approximately 20 percent the overall length of said mopping member along said handle.

* * * * *